US011658020B2

(12) United States Patent
Vollero

(10) Patent No.: US 11,658,020 B2
(45) Date of Patent: May 23, 2023

(54) ION SOURCE ASSEMBLY WITH MULTIPLE IONIZATION VOLUMES FOR USE IN A MASS SPECTROMETER

(71) Applicant: INFICON, Inc., East Syracuse, NY (US)

(72) Inventor: Michael F. Vollero, Manlius, NY (US)

(73) Assignee: INFICON, Inc., East Syracuse, NY (US)

( * ) Notice: Subject to any disclaimer, the term of this patent is extended or adjusted under 35 U.S.C. 154(b) by 0 days.

(21) Appl. No.: 17/357,348

(22) Filed: Jun. 24, 2021

(65) Prior Publication Data

US 2022/0165559 A1 May 26, 2022

Related U.S. Application Data

(60) Provisional application No. 63/117,708, filed on Nov. 24, 2020.

(51) Int. Cl.

| | |
|---|---|
| ***H01J 49/16*** | (2006.01) |
| ***H01J 49/06*** | (2006.01) |
| ***H01J 49/26*** | (2006.01) |

(52) U.S. Cl.

CPC ..... *H01J 49/16* (2013.01); *H01J 49/062* (2013.01); *H01J 49/068* (2013.01); *H01J 49/26* (2013.01)

(58) Field of Classification Search

CPC ..... H01J 49/16; H01J 49/062; H01J 49/068; H01J 49/26

USPC ..... 250/281, 282, 288

See application file for complete search history.

(56) References Cited

U.S. PATENT DOCUMENTS

| | | | |
|---|---|---|---|
| 3,621,240 | A | 11/1971 | Cohen et al. |
| 4,782,235 | A | 11/1988 | Lejeune et al. |
| 5,401,962 | A | 3/1995 | Ferran |
| 5,808,308 | A | 9/1998 | Holkeboer |
| 5,834,770 | A | 11/1998 | Holkeboer et al. |
| 5,850,084 | A | 12/1998 | Holkeboer |
| 6,091,068 | A | 7/2000 | Parfitt et al. |
| 7,049,583 | B2 | 5/2006 | Bateman et al. |
| 7,230,237 | B2 | 6/2007 | Ueno |
| 7,381,947 | B2 | 6/2008 | Senko |
| 7,449,686 | B2 | 11/2008 | Wang et al. |

(Continued)

OTHER PUBLICATIONS

PCT/US2021/060542; filed Nov. 23, 2021; International Search Report dated Feb. 25, 2022 (9 pages).

*Primary Examiner* — Michael Maskell

(74) *Attorney, Agent, or Firm* — Barclay Damon LLP

(57) ABSTRACT

An ion source assembly for use in a mass spectrometer comprises a first anode defining a first ionization volume and a first electron source positioned proximate the first anode and configured to generate electrons that pass through the first anode and into the first ionization volume. The ions source assembly further includes a second anode defining a second ionization volume and a second electron source positioned proximate to the second anode and configured to generate to generate electrons that pass through the second anode and into the second ionization volume. At least one optical element is positioned proximate the first ionization volume and defines an aperture. The first and second anodes and the first and second ionization volumes are positioned along an ion optical axis of the mass spectrometer, and the first anode is positioned between the second anode and the aperture.

18 Claims, 6 Drawing Sheets

(56) References Cited

U.S. PATENT DOCUMENTS

| | | | | |
|---|---|---|---|---|
| 8,664,591 | B2 | 3/2014 | Newton | |
| 8,633,435 | B2 | 6/2014 | Kenny et al. | |
| 9,786,479 | B2 | 10/2017 | Green et al. | |
| 9,831,076 | B2 | 11/2017 | Kovtoun | |
| 10,253,624 | B2 | 4/2019 | Van Hal et al. | |
| 2009/0032702 | A1* | 2/2009 | Quarmby | H01J 49/147 313/341 |
| 2016/0172170 | A1* | 6/2016 | Murthy | H01J 49/06 250/288 |

* cited by examiner

301

ION SOURCE ASSEMBLY WITH MULTIPLE IONIZATION VOLUMES FOR USE IN A MASS SPECTROMETER

CROSS-REFERENCE TO RELATED APPLICATIONS

This application claims the benefit of and priority to U.S. Patent Application Ser. No. 63/117,708, filed on Nov. 24, 2020, the contents of which are incorporated herein by reference.

FIELD OF TECHNOLOGY

This disclosure is directed to an ion source assembly with multiple ionization volumes where each ionization volume comprises a separate electron source.

BACKGROUND

Mass spectrometry is a common analytical technique used to measure the mass-to-charge ratio of ions in a sample in order to determine the chemical composition of the sample. Generally, mass spectrometry requires ionization of the sample, separating the ions according to their mass-to-charge ratio, detecting the separated ions, and displaying the results as spectra showing signal intensity of the detected ions as a function of the mass-to-charge ratio. Ionizing a sample, specifically a gaseous sample, may be done using an electron bombardment ionization source, a.k.a. an electron ionization (EI) ion source. The EI ion source includes a source of electrons, which may be a filament that is heated to a temperature at which it emits electrons. The filament that is used may be a fine wire comprised of refractory metal that is either uncoated or coated with a metal oxide. The heating of the filament may be done resistively by passing an electric current through the filament. The thermionically emitted electrons from the filament are accelerated through a wall or anode and into an ionization volume. The movement of the electrons is guided by electric potential differences maintained between the filament and the anode by means of a control unit. The anode defines at least one opening that enables some percentage of the electrons to pass through the anode and into the ionization volume. It is generally desirable to maintain the filament temperature and various electric potentials so that a constant electron emission current passes into the ionization volume. Additional electrodes, such an electron repeller, may be included for steering the electrons. Inside the ionization volume, at least some of the accelerated or energetic electrons will collide with molecules of the gas sample that is in the ionization volume. The electrons have sufficient energy such that, upon colliding with the gas molecules, they will ionize and/or fragment the gas molecules to produce ions.

These ions are then accelerated and steered by means of other potentials established on ion optical elements that are part of the ion source into the mass filter. Some ion sources also include an ion repeller positioned upstream of the ionization volume. The ion repeller may be set to a specific electric potential in order to aid in controlling trajectories of the ions generated in the ionization volume. The ion repeller may be a flat or planar electrode or it may be concaved in a direction towards the mass filter. When the ions having various mass-to-charge ratios reach the mass filter they are separated either spatially or temporally. The ions are then detected by an ion detector and a mass spectrum is determined from the output of the ion detector.

The filament of the EI ion source has a finite lifetime of use. In order to emit sufficient numbers of electrons, the filament must run at temperatures between 1500-2400 K. At these high temperatures the filament wire (and the coating if present) eventually evaporate resulting in filament failure. Filament failure may also occur as a result from changes in the crystal structure of the filament wire that take place at the high operating temperatures. Additionally, the electron-emitting surface of the filament may be chemically altered by the gases in the system, which increases the work function of the electron-emitting surface while decreasing the electron emission efficiency of the electron-emitting surface. When no electrons or insufficient electrons are available to ionize the gas sample due to a broken, misshapen, or chemically "poisoned" filament, the mass spectrometer no longer functions satisfactorily. Consequently, a process that is being monitored and/or controlled based on data produced by the mass spectrometer would have to be stopped or else "run blind" until there is an opportunity to replace the filament. Replacement of the filament is a time consuming and inconvenient process since the filament is often located inside of a process vacuum chamber such that the process vacuum chamber must be vented to perform this replacement. Therefore, it is desirable to reduce the frequency of filament replacement and more preferable to be able to schedule when a pre-emptive filament replacement occurs so the filament may be replaced at the same time that the process chamber is off-line for other maintenance activities.

One commonly employed method of addressing this disadvantage of EI ion sources is to include a second filament in the ion source that is positioned near the anode and may be brought into operation when the first filament fails. The two filaments are usually copies of each other and are mirrored about a plane that extends along the ion-optical axis of the ion source. Positioning the filaments in this manner is done in an effort to maintain consistent performance of the mass spectrometer by enabling ions to be formed in the same regions of the ionization volume regardless of which filament is in use. This ensures that the ions are generated in a location where the electric fields are able to steer the ions so they are injected successfully into the mass filter and where the electric fields are high enough to overcome space-charge effects on sensitivity. However, one drawback of this type of EI ion source is that the space available near the anode is generally limited so each of the two filaments is shorter than that filament used when there is only a single filament. The relation of electron emission current density leaving an electron-emission surface to that surface's temperature and work function is described by the Richardson equation as a monotonically increasing function of temperature. Since the total electron emission current depends on the area of the emitting surface, a shorter filament must be operated at a higher temperature in order to obtain the same total emission current. Therefore, two shorter filaments operated sequentially do not last twice as long as one long filament. In fact, the combined operating life of the two short filaments may not even be as long as the operating life of the single filament at the "normal" length. Moreover, a shorter filament necessarily loses more heat to its mounting arrangement than a longer filament. This loss of heat is due to the lower thermal resistance offered by the shorter path along the wire from the central region of the filament to the mounting points than compared to the longer, single filament. As a result, even higher temperatures are required at the hottest parts (near the center) of the filament in order to keep total electron emission at the required levels, which reduces the operating life of the filament.

Two key properties of an ion source are sensitivity (number of ions created and injected into the mass filter with acceptable velocities per unit pressure) and linearity (degree to which the sensitivity is independent of pressure). These properties cannot be disregarded entirely in an attempt to extend filament lifetime. For example, the emission current and/or the operating pressure may be decreased in an effort to decrease the filament temperature and thus extend the filament life. However, the reduction in emission current or operating pressure is done at the expense of sensitivity and/or ion current.

These are just some of the disadvantages associated with ion sources currently used in mass spectrometers.

SUMMARY

An embodiment of an ion source assembly for use in a mass spectrometer comprises a first anode defining a first ionization volume and a first electron source positioned proximate the first anode and configured to generate electrons that pass through the first anode and into the first ionization volume. The embodiment of the ion source assembly further comprises a second anode defining a second ionization volume and a second electron source positioned proximate to the second anode and configured to generate electrons that pass through the second anode and into the second ionization volume. At least one optical element is positioned proximate the first ionization volume and defines an ion exit from the ion source. The first and second anodes and the first and second ionization volumes are positioned along an ion optical axis of the mass spectrometer, and the first anode is positioned between the second anode and the ion exit.

In an embodiment, the first electron source comprises a first filament and the second electron source comprises a second filament and the first and second filaments are configured to be heated to emit electrons. In an embodiment, the first and second filaments are comprised of approximately identical dimensions. In an embodiment, the first and second filaments are comprised of different dimensions. In an embodiment, the first and second filaments are comprised of a same material. In an embodiment, the first filament is comprised of a different material than the second filament. In an embodiment, one of the first filament and the second filament is comprised of a tungsten alloy. In an embodiment, one of the first and second filament is comprised of oxide-coated iridium. In an embodiment, the ion source assembly further comprises a conductive endcap positioned between the first ionization volume and the second ionization volume, wherein the conductive endcap allows ions to pass from the second ionization volume into the first ionization volume. In an embodiment, the conductive endcap is planar. In an embodiment, the conductive endcap comprises a concave shape directed toward the first ionization volume.

An embodiment of a method of operating an ion source in a mass spectrometer comprises directing an electric current to a first electron source, heating the first electron source to emit electrons, directing the electrons emitted from the first electron source through a first anode and into a first ionization volume, and using the electrons to generate ions within the first ionization volume. The method further comprises diverting the electric current from the first electron source to a second electron source, heating the second electron source to emit electrons, directing the electrons emitted from the second electron source through a second anode and into a second ionization volume, and using the electrons to generate ions within the second ionization volume. The ions are guided from the second ionization volume to an ion exit using a potential applied to the first anode. The first anode, the second anode, the first ionization volume, and the second ionization volume are positioned along an ion optical axis of the mass spectrometer, and the first anode is positioned between the second anode and the ion exit.

In an embodiment, the method of operating an ion source in a mass spectrometer further comprises setting a potential of the first electron source equal to the potential of the first anode when the second electron source is emitting electrons and ions are generated in the second ionization volume. In another embodiment, diverting the electric current from the first electron source to the second electron source is done after a failure of the first electron source.

An embodiment of a method of operating an ion source in a mass spectrometer to analyze a gas sample comprises providing an ion source assembly comprising a first anode defining a first ionization volume, and a first electron source comprised of a first material and configured to emit electrons through the first anode into the first ionization volume. The ion source assembly further comprises a second anode defining a second ionization volume, and a second electron source comprised of a second material and configured to emit electrons through the second anode into the second ionization volume. The second material is different from the first material and comprises different chemical properties than the first material. The ion source assembly further comprises at least one ion optical element defining an ion exit. One of the first and second electron sources is operated for analysis of the gas sample based on a tolerance of the first material and the second material to the gas sample. The first anode, the second anode, the first ionization volume, and the second ionization volume are positioned along an ion optical axis of the mass spectrometer, and the first anode is positioned between the second anode and the ion exit

BRIEF DESCRIPTION OF DRAWINGS

A more particular description of the invention briefly summarized above may be had by reference to the embodiments, some of which are illustrated in the accompanying drawings. It is to be noted, however, that the appended drawings illustrate only typical embodiments of this invention and are therefore not to be considered limiting of its scope, for the invention may admit to other equally effective embodiments. Thus, for further understanding of the nature and objects of the invention, references can be made to the following detailed description, read in connection with the drawings in which.

DETAILED DESCRIPTION

The following discussion relates to various embodiments of an ion source assembly with multiple ionization volumes. It will be understood that the herein described versions are examples that embody certain inventive concepts as detailed herein. To that end, other variations and modifications will be readily apparent to those of sufficient skill. In addition, certain terms are used throughout this discussion in order to provide a suitable frame of reference with regard to the accompanying drawings. These terms such as "upper", "lower", "forward", "rearward", "interior", "exterior", "front", "back", "top", "bottom", "inner", "outer", "first", "second", and the like are not intended to limit these concepts, except where so specifically indicated. The terms "about" or "approximately" as used herein may refer to a range of 80%-125% of the claimed or disclosed value. With regard to the drawings, their purpose is to depict salient features of the ion source assembly with multiple ionization volumes and are not specifically provided to scale.

Figure 1:
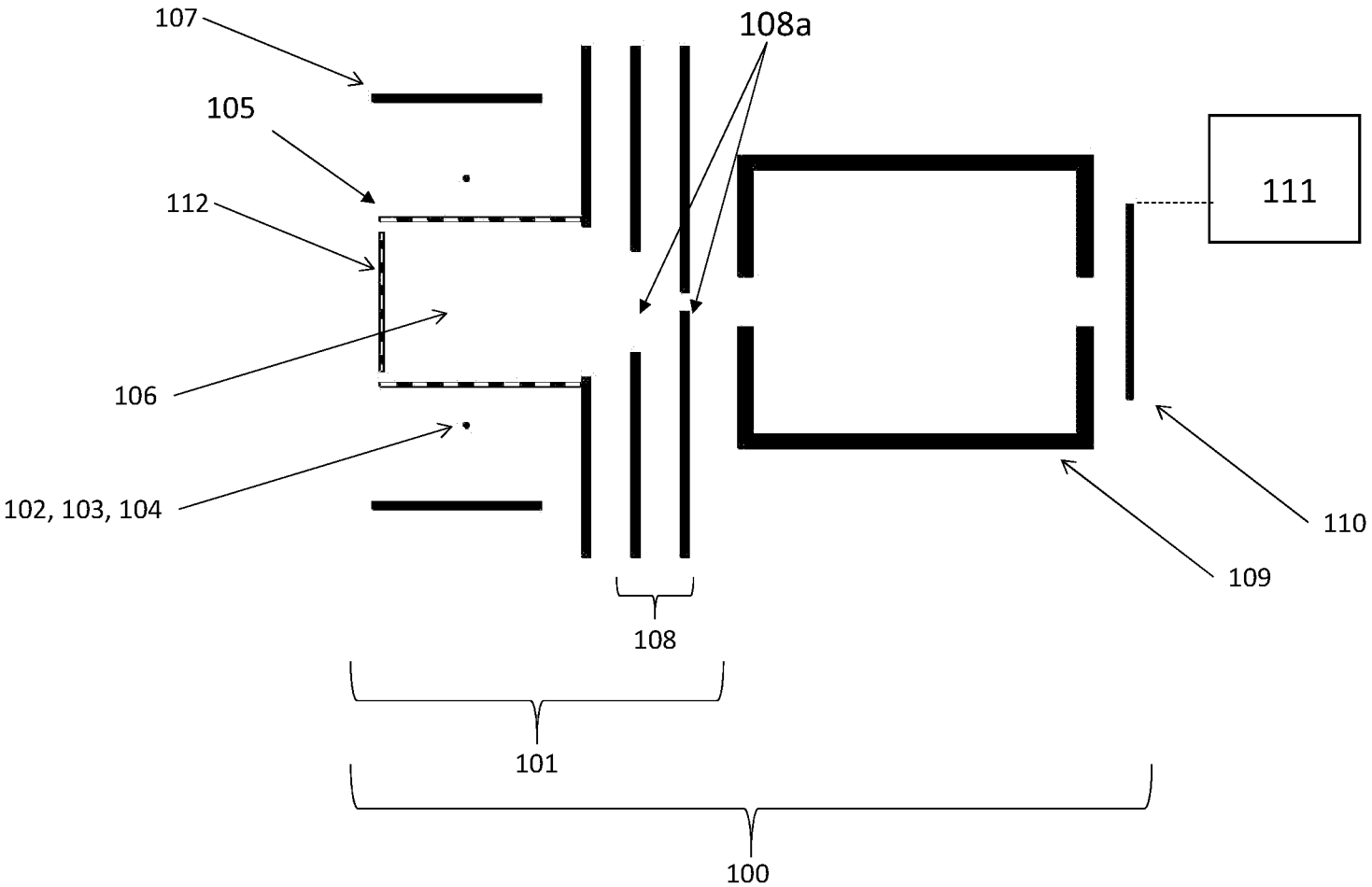
FIG. 1 illustrates a cross-sectional view of a schematic depiction of an embodiment of a prior art ion source in a mass spectrometer.

FIG. 1 shows a cross-sectional view of a portion of a prior art mass spectrometer 100 having an electron ionization (EI) ion source 101. The EI ion source 101 includes a source of electrons 102, an anode 105 defining or at least partially surrounding an ionization volume 106, one or more electron repellers 107, and one or more ion repellers 112. As shown, the source of electrons is a filament 102, such as a thin wire, that is heated to a temperature (1500-2400 K) at which the filament 102 emits electrons. The filament 102 may be comprised of a refractory metal 103 that may be coated with a metal oxide 104. The filament 102 may be connected to a source of electrical current to enable the electrical current to pass through the filament 102 in order to heat the filament 102 to a temperature at which electrons are emitted from the filament 102. As shown, the anode 105 is spaced apart from the filament 102 and is generally positioned between the filament 102 and the ionization volume 106. Additional electrodes, such as one or more electron repellers 107 may be included and configured to steer the electrons emitted from the filament 102. As shown, the electron repeller 107 is positioned radially outward from the filament 102 such that the filament 102 is positioned between the electron repeller 107 and the anode 105. The thermionically emitted electrons from the filament 102 may be steered by the electron repeller 107 and accelerated through an electrical potential difference that is established between the filament 102 and the anode 105 of the ionization volume 106. The electric potentials that exist on components of the ions source are established and maintained by a control unit (not shown) or control electronics (not shown). These potentials may also be adjusted via the control unit (not shown). The electrons pass through openings 105*a* (FIG. 2) defined on the anode 105 and into the ionization volume 106 where at least some of the electrons will collide with molecules of the gas sample that are present in the ionization volume 106. The electrons have sufficient energy such that, upon colliding with the gas molecules, they will ionize and/or fragment the gas molecules to produce ions.

As shown, the ion source 101 further includes one or more optical elements 108 that define an ion exit, which could be an aperture 108*a* or a grid, and are configured to establish electric potentials which act to accelerate and steer the ions produced in the ionization volume 106 into the mass filter 109. The mass filter 109 separates the ions of various mass-to-charge ratios either spatially or temporally. The ions are then detected by an ion detector 110 and the mass spectrum is determined from the output of the ion detector 110. In an embodiment, the ion detector 110 is in electrical communication with an interface 111 on Which the output of the ion detector 110 and/or the mass spectrum may be displayed. In some embodiments of the ion source 101, an ion repeller 112 is positioned upstream of the ionization volume 106 and is set to a specific electric potential in order to aid in controlling trajectories of the ions produced.

Figure 2:
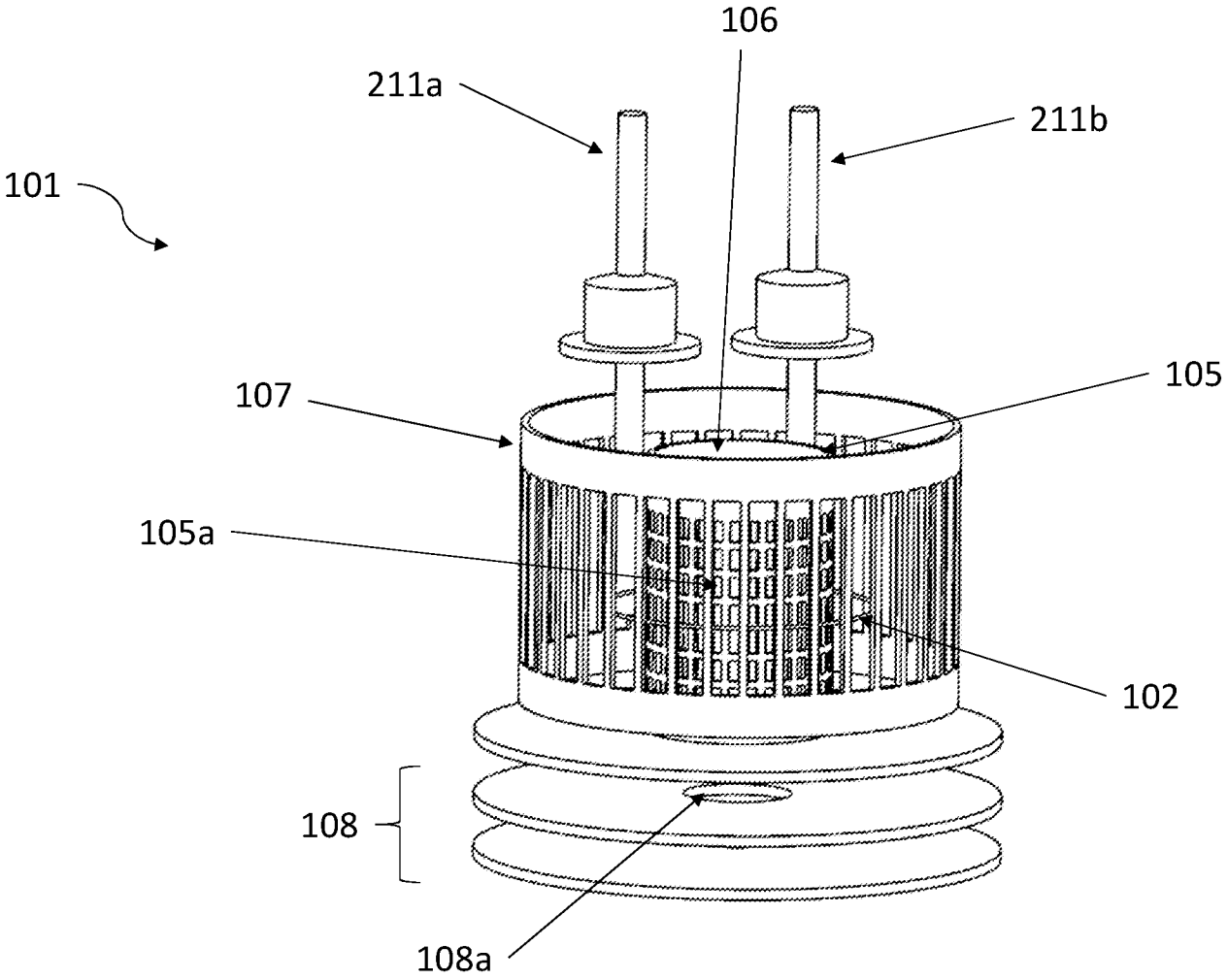
FIG. 2 illustrates a perspective view of an embodiment of a prior art ion source for use in a mass spectrometer.
Figure 3A:
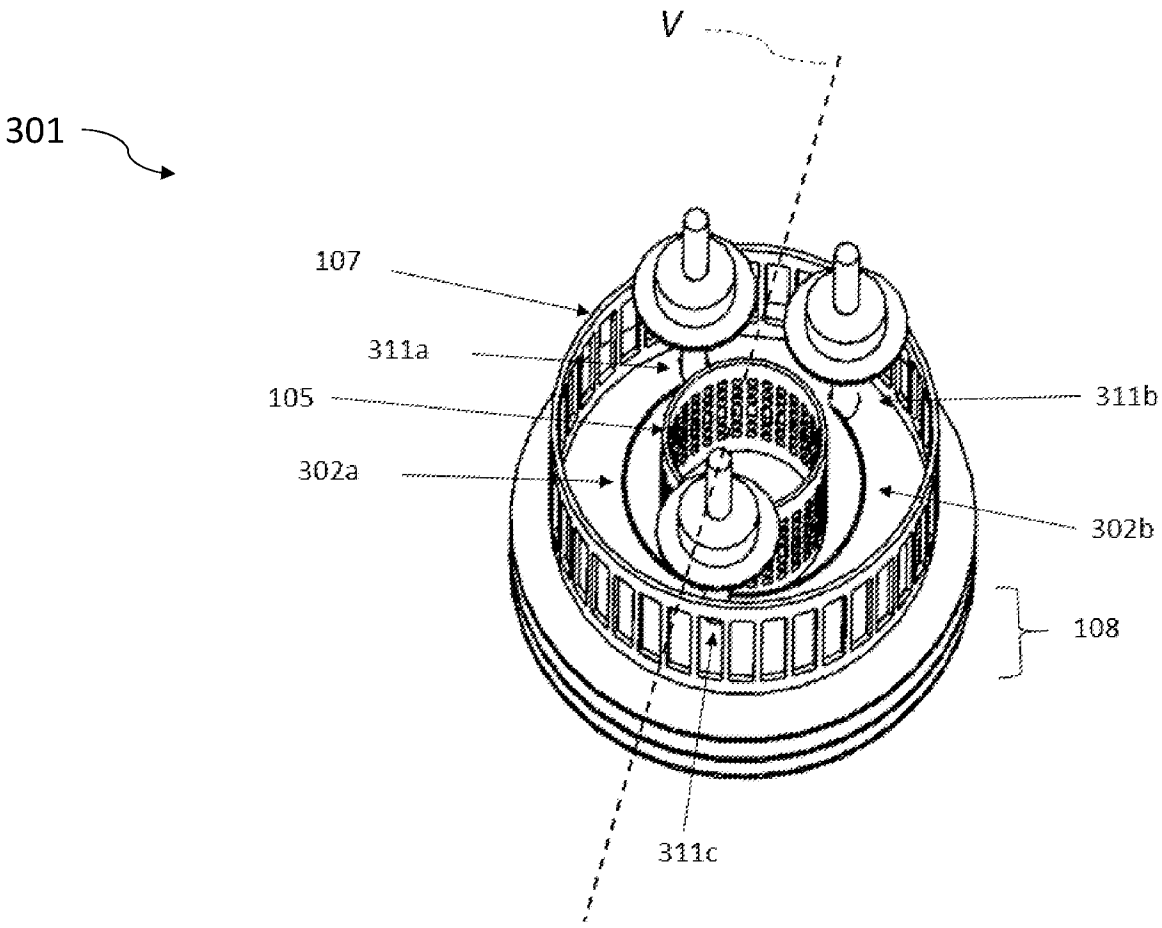
FIG. 3A illustrates a top perspective view of an embodiment of a prior art ion source for use in a mass spectrometer.
Figure 3B:
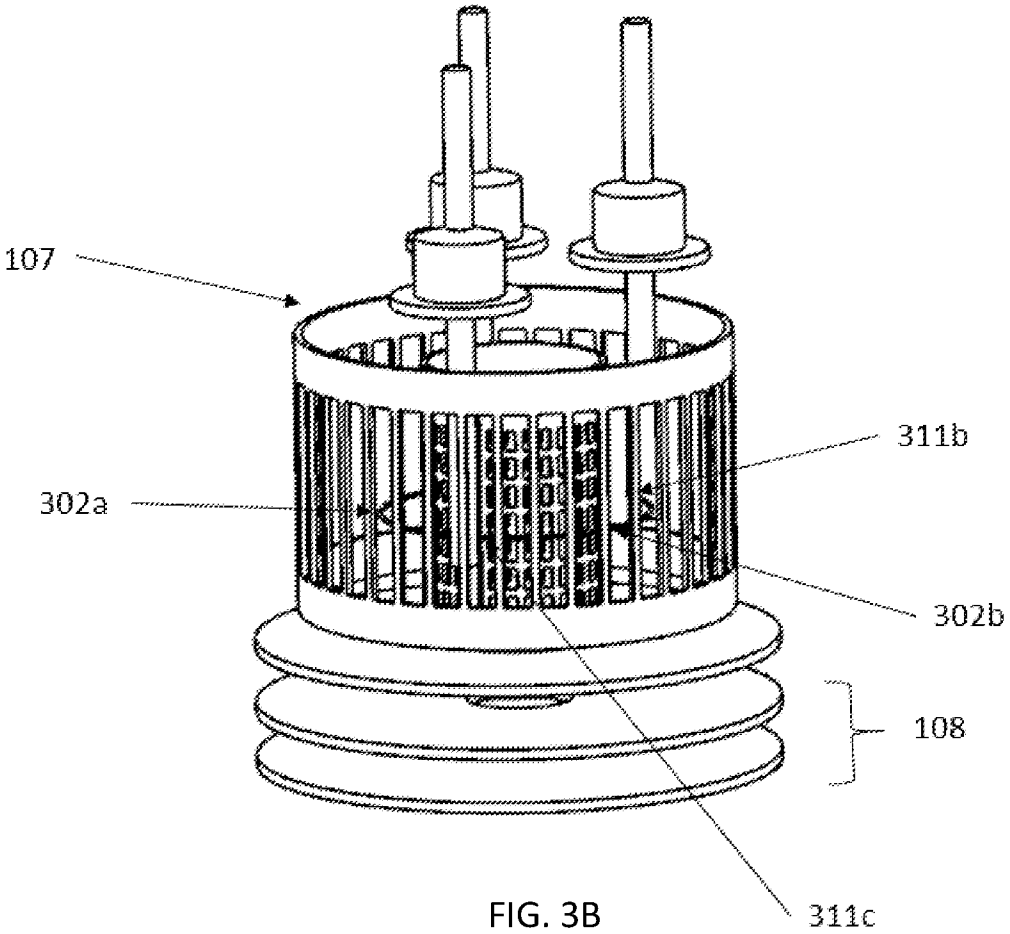
FIG. 3B illustrates a side perspective view of an embodiment of a prior art ion source for use in a mass spectrometer.

Referring now to FIG. 2, which shows a perspective view of the embodiment of the ion source 101 from FIG. 1. As shown, the single filament 102 extends a length from a first end to a second end. The first end of the filament 102 is connected to and supported by a first support member 211*a* and the second end of the filament 102 is connected to and supported by a second support member 211*b*. FIGS. 3A-B illustrates an embodiment of the prior art dual filament ion source 301. As can be seen, two shorter filaments 302*a*, 302*b* have replaced the single, long filament 102 from the embodiment of FIG. 2. The first filament 302*a* extends a length from a first end that is connected to and supported by a first support member 311*a*, to a second end. The second filament 302*b* extends a length from a first end that is connected to and supported by a second support member 311*b*, to a second end. The second ends of both the first and second filaments 302*a*, 302*b* are connected to a third or common support member 311*c*. Together, the length of the first filament 302*a* and the length of the second filament 302*b* may approximate the length of the single filament 202 of the embodiment of FIG. 2. The first and second filaments 302*a*, 302*b* are positioned relative to vertical plane V such that they are mirror images of each other. The vertical plane V extends along the optical axis of the ion source.

Figure 4:
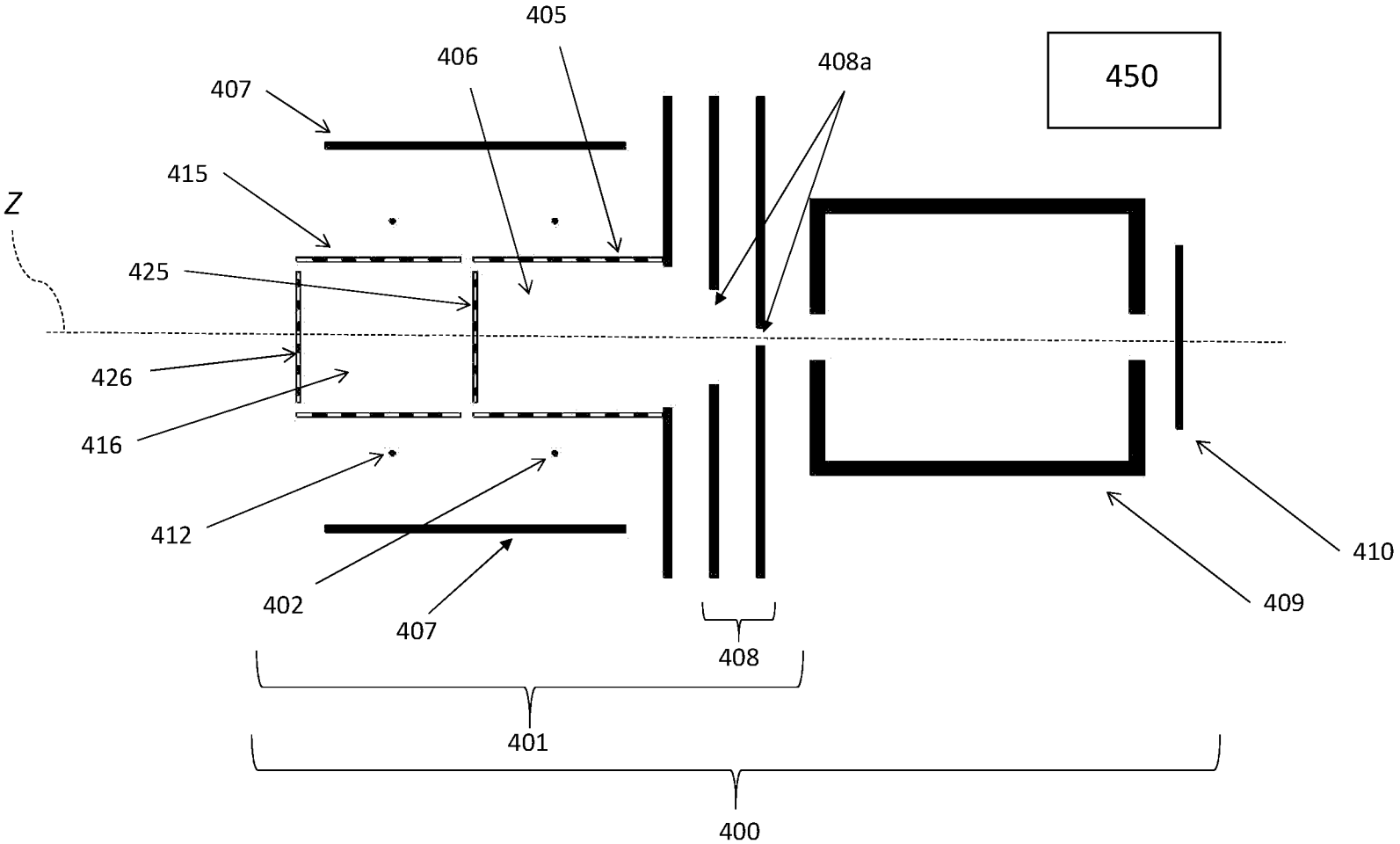
FIG. 4 illustrates a cross-sectional view of a schematic depiction of an embodiment of an ion source assembly according to the present invention in a mass spectrometer.
Figure 5:
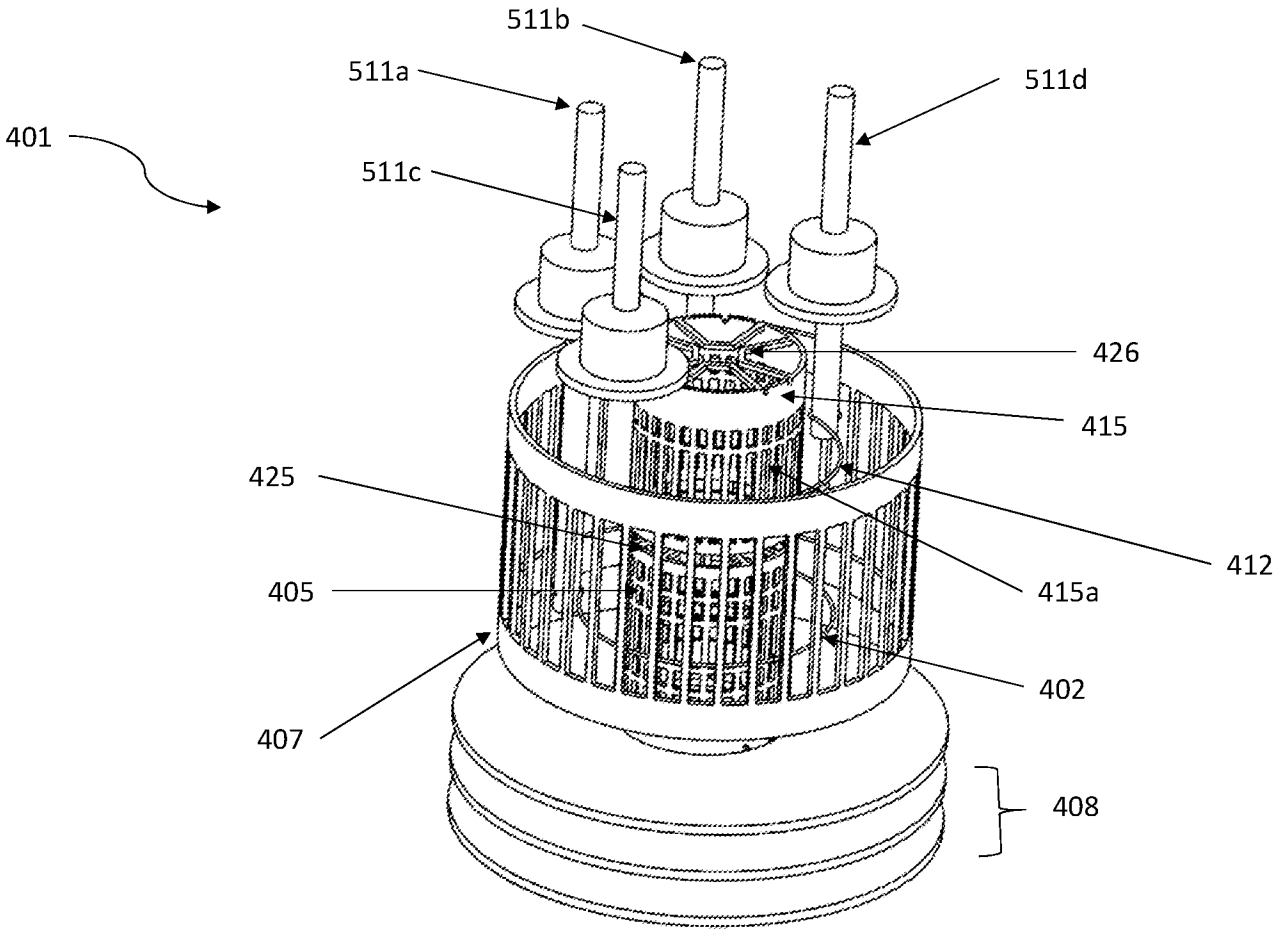
FIG. 5 illustrates a top perspective view of an embodiment of an ion source assembly for use in a mass spectrometer according to the present invention.

FIGS. 4 and 5 show an embodiment of the inventive multiple ionization volume ion source assembly 401 ("ion source assembly") for a mass spectrometer 400. The multiple ionization volume ion source assembly 401 generally comprises at least two ionization volumes. As shown, the ion source assembly 401 includes a first source of electrons, such as a first filament 402, a first anode 405 defining or at least partially surrounding a first ionization volume 406. The ion source assembly 401 further includes a second electron source, such as a second filament 412, positioned proximate to a second anode 415. The second filament 412 may be approximately the same length as the first filament 402. A plurality of support members 511*a-d* (FIG. 5) are configured to connect to and support the first and second filaments 402, 412. Each of the two filaments 402, 412 may be supported by two or more of the support members 511*a-d*. The second anode 415 at least partially surrounds a second ionization volume 416. As shown in FIG. 5, the first and second anodes 405, 415 may define one or more openings 405*a*, 415*a* that traverse the first and second anode 405, 415, respectively. The second anode 415 and the second ionization volume 416 are positioned upstream relative to the first anode 405 and the first ionization volume 406 along the ion optical axis Z of the ion source assembly 401.

Similar to the filaments of the prior art, the first filament 402 and the second filament 412 of the ion source assembly 401 may be comprised of a refractory metal that may be coated with a metal oxide. The first and second filaments 402, 412 may be identical to each other, or may be a different length from one another and comprised of different materials from one another. Each of the first and second filaments 402, 412 can be connected to a source of electrical current to enable the electrical current to pass through the first and second filaments 402, 412 in order to heat the first and second filaments 402, 412 to a temperature at which electrons are emitted from each of the first and second filaments 402, 412. As shown, the first anode 405 and the second anode 415 are spaced apart from the first and second filaments 402, 412. In this configuration, the first anode 405 is generally positioned between the first filament 402 and the first ionization volume 406 while the second anode 415 is generally positioned between the second filament 412 and the second ionization volume 416.

Referring to FIG. 4, the ion source assembly further comprises one or more electron repellers 407 that act to steer the electrons emitted from the first and second filaments 402, 412. As shown in FIG. 5, the electron repeller 407 is positioned radially outward from the first and second filaments 402, 412 such that the first and second filaments 402, 412 are positioned between the electron repeller 407 and the first and second anodes 405, 415. Accordingly, the thermionically emitted electrons from the first and/or second filaments 402, 412 may be steered by the electron repeller 407 and accelerated through an electrical potential difference that is established between the first and second filaments 402, 412 and the first and second anodes 405, 415. The ion source assembly 401 may further comprise a control unit/control electronics 450 that is in electrical communication with the ion source assembly 401 and configured to establish and maintain the electric potentials that exist on components of the ions source assembly 401. These electric potentials may also be adjusted via the control unit 450. The electrons emitted by the first and second filaments 402, 412 pass through openings 405*a*, 415*a* defined on the first and second anode 405, 415, respectively and into the first and/or second ionization volume 406, 416. At least some of the electrons in the first and/or second ionization volume 406, 416 will collide with molecules of the gas sample that are present in the ionization volumes 406, 416. The electrons have sufficient energy such that, upon colliding with the gas molecules, they will ionize and/or fragment the gas molecules to produce ions.

The ions pass through one or more optical elements 408 that each define a passage or orifice 408*a* and into a mass filter 409 that separates ions of various mass-to-charge ratios either spatially or temporally. The ions are then detected by an ion detector 410 and the mass spectrum is determined from the output of the ion detector 410. In an embodiment, the ion detector 410 is in electrical communication with an interface on which the output of the ion detector 410 and/or the mass spectrum may be displayed. In an embodiment, the interface may be part of the control unit 450. The ion source assembly 401 improves ion source lifetime and enables the use different filament materials because it uses two long filaments that are both positioned at locations along the optical axis (or vertical plane V) where good ion current linearity with respect to pressure can be had at the same time as good sensitivity.

For example, when the second filament 402 is in operation, the potential on the first anode 405 may be adjusted via the control unit 450 such that the first anode 405 acts as an extraction and focusing optical element to transport the ions generated in the second ionization volume 416 to the optical elements 408 and thus into the mass filter 409. By using the first anode 405 as an extraction and focusing optical element, the sensitivity and linearity of the ion source assembly 401 with respect to pressure may be adjusted when the second filament 412 is in use. This level of adjustment is not possible if the second filament 412 is positioned farther away from the mass filter 409 along the optical axis (vertical plane V) and deeper into a single, longer anode.

As mentioned, in an embodiment, the second filament 412 may be a duplicate of the first filament 402 having a length approximately equal to the length of the second filament 412, allowing a possible doubling of the time between filament replacement functions. In other embodiments, the second filament 412 may be a different length and/or comprised of a different material with respect to the first filament 402. In a specific embodiment, the second filament 412 may be shorter than the first filament 402 to save allowable space in the mass spectrometer. In this embodiment, the shorter second filament 412 may act as a "mini-spare" in order to allow continued use of the instrument until the next scheduled maintenance time, rather than necessarily doubling the operating time between failures.

In another embodiment, the second filament 412 may be comprised of a different material than the first filament 402 such that the ion source assembly 401 can be used in a mass spectrometer to sequentially analyze or monitor different gas samples where the material of each filament is selected to best suit the chemistry of each sample. For example, one filament may be comprised of a tungsten alloy and the other filament may be comprised of an oxide-coated iridium. This embodiment of the ion source assembly 401 may be particularly useful in a portable GC/MS system in which the operator may switch from sampling a hydrogen carrier stream from a GC to direct sampling of room air through an appropriate pressure reduction interface, (e.g., an orifice or a thin membrane) into the mass spectrometer. In this case, a filament comprised of a tungsten alloy would be used for the GC stream since hydrogen would destroy the yttria coating that is present on the iridium filament. The yttria-coated iridium filament would be used for the air sample since the oxygen in the air would quickly destroy the hot tungsten filament.

Still referring to FIGS. 4-5, the first anode 405 of the ion source assembly 401 may include a section or first endcap 425 that is electrically connected to the first anode 405 and acts to delineate the first ionization volume 406 from the second ionization volume 416. In another embodiment, the first endcap 425 may be a separate electrode similar to the ion repeller 112 of FIG. 1. The first endcap 425 may be comprised of a conductive material that is configured to enable ions to pass through it. In an embodiment, the first endcap 425 is at least partially comprised of a conducting grid or mesh. Inclusion of the first endcap 425 between the first ionization volume 406 and the second ionization volume 416 has been shown to improve performance of the ion source assembly 401, particularly when operating the second filament 412. However, the first endcap 425 may accumulate non-conducting surface contaminants over time depending on the chemistry in the process chamber. While this build-up of a non-conductive film on the first endcap 425 could affect the performance of the ion source assembly 401, such a build-up may also affect the performance of any embodiment of any ion source.

The second anode 415 may similarly include a second endcap 426 that acts to better define the electric potentials inside of the second ionization volume 416. The second endcap 426 may be similar to the first endcap 425. As such, second endcap 426 may also be comprised of a conducting material, however it is not necessary for the conducting material to allow the passage of ions though the second endcap 426. In an embodiment, the conducting material of the second endcap 426 defines one or more openings to enable a free flow of gas into and out of the ionization volume 416. The second endcap 426 may be electrically connected to the second anode 415 and configured to run at the same potential as the second anode 415. In another embodiment, the second endcap 426 may be a separate electrode, as with the ion repeller 112 previously described. The second endcap 426 may comprise many different geometries including a flat or planar shape or a shape that is generally concave towards the mass filter 409.

A further embodiment of the ion source assembly that is not shown comprises a third ionization volume, third anode, and a third electron source positioned upstream from the second ionization volume 416. In this embodiment, one or more of the components may be the same or similar to components previously described with regard to the ion source assembly 401.

In a specific example, the ion source assembly 401 may be installed on a residual gas analyzer (RGA) upstream of the mass filter 409 and ion detector 410. In this example the mass filter 409 is a quadrupole mass filter, the ion detector 410 is a faraday cup ion detector, and the RGA is being used to monitor gases in a vacuum process chamber. The first and second filaments 402, 412 of the ion source assembly 401 are two yttria-coated iridium filaments that are each positioned proximate to their respective anodes. The two anodes are formed from a 304 stainless steel mesh. Stainless steel ion optical elements 408, such as a focus lens and an exit aperture plate, are used to define and inject a beam of ions into the quadrupole mass filter 409. Initially, a current from the control electronics is used to resistively self-heat the first filament 402 to a temperature such that 2 mA of emission current in the form of electrons leaves the surface of the first filament 402. The first filament 402 is biased such that the filament center is 110 V. The first anode 405 is biased by the control electronics to 212 V, the focus lens is at 185V, and the exit aperture plate 408 and electron repeller 407 are at 0 V. These voltages are all relative to the walls of the vacuum chamber being monitored. The electrons emitted from the first filament 402 are accelerated by the 102 V difference between the first anode 405 and the first filament 402. The electrons enter through the mesh of the first anode 405 into the first ionization volume 406. The electrons collide with molecules of the gas being monitored, knocking loose electrons and fragmenting the gas molecules to create the ions to be analyzed by the quadrupole mass filter 409. While the first filament 402 is in use, the second anode 415 may be held at 215 V or some other voltage, and the second filament 412 may be held at 0V. The quadrupole is operated in the normal way, such that the central axis (pole zero) is at 202 V.

Operation may continue in this manner until the first filament 402 fails. At that time, the filament current is sent to the second filament 412, which will now have its center biased to 110 V. The second anode 415 is set to 212 V so now there is 2 mA of 102 eV electrons entering the second ionization volume 416. The first anode 405 is now set to 206 V and acts to pull ions out of the second ionization volume 416 and direct them towards the focus lens and exit aperture plate 408, and then into the quadrupole mass filter 409. When operating the second filament 412 as the electron source, the first filament 402 may be set to the same voltage as the first anode 405 (206 V in this example) so that if the first filament 402 is broken and is touching the anode 405, there is no electrical current flow between the first anode 405 and the first filament 402. Operation of the RGA may then continue as it did prior to the filament failure with these new potential settings.

While the invention has been mainly described as a way to get similar ion currents from an ion source while using a second filament as are obtained from use of a first filament and while extending the operating time between required ion source maintenance actions, this is not necessarily the only way that the ion source assembly 401 may be operated. The sensitivity and the linearity of an ion source depend on the electric fields determined in the ion source by the potentials applied to the various electrodes by the control unit control electronics. Therefore, it is possible to customize electrode settings for each of the first filament 402 and the second filament 412. In other words, when the first filament 402 is being operated, the applied electrode settings optimize the resulting ion beam for a specific feature of the resulting ion beam. Likewise, when the second filament 412 is being operated, the applied electrode settings optimize the resulting ion beam for a specific feature of the resulting ion beam. For example, electrode potentials could be chosen to optimize linearity when using the first filament 402 and sensitivity when using the second filament 412. In an alternate example, the electrode potentials may be selected to direct ions of one energy from the first ionization volume 406 into the mass filter 409, and to direct ions of another energy from the second ionization volume 416 into the mass filter 409. In another example, both filaments 402, 412 may be operated simultaneously, although this would result in a wider range of ion energies entering the mass filter 409.

While the present invention has been particularly shown and described with reference to certain exemplary embodiments, it will be understood by one skilled in the art that various changes in detail may be effected therein without departing from the spirit and scope of the invention that can be supported by the written description and drawings. Further, where exemplary embodiments are described with reference to a certain number of elements, it will be understood that the exemplary embodiments can be practiced utilizing either less than or more than the certain number of elements.

The invention claimed is:

1. An ion source assembly for use in a mass spectrometer, the ion source assembly comprising:

a first anode at least partially surrounding a first ionization volume;

a first electron source positioned proximate to the first anode and configured to generate electrons that pass through the first anode and into the first ionization volume;

a second anode at least partially surrounding a second ionization volume;

a second electron source positioned proximate to the second anode and configured to generate electrons that pass through the second anode and into the second ionization volume; and at least one optical element proximate the first ionization volume and defining an ion exit from the ion source, wherein the first and second anodes and the first and second ionization volumes are positioned along an ion optical axis of the mass spectrometer, and wherein the first anode is positioned between the second anode and the ion exit.

2. The ion source assembly of claim 1, wherein the first electron source comprises a first filament and the second electron source comprises a second filament, and wherein the first and second filaments are configured to be heated to emit electrons.

3. The ion source assembly according to claim 2, wherein the first and second filaments are comprised of approximately identical dimensions.

4. The ion source assembly according to claim 2, wherein the first and second filaments are comprised of different dimensions.

5. The ion source assembly according to claim 2, wherein the first and second filaments are comprised of a same material.

6. The ion source assembly according to claim 2, wherein the first filament is comprised of a different material than the second filament.

7. The ion source assembly according to claim 6, wherein one of the first filament and the second filament is comprised of a tungsten alloy.

8. The ion source assembly according to claim 7, wherein one of the first filament and the second filament is comprised of oxide-coated iridium.

9. The ion source assembly according to claim 1, further comprising a conductive endcap positioned between the first ionization volume and the second ionization volume, wherein the conductive endcap allows ions to pass from the second ionization volume into the first ionization volume.

10. The ion source assembly according to claim 9, wherein the conductive endcap is planar.

11. The ion source assembly according to claim 9, wherein the conductive endcap comprises a concave shape directed toward the first ionization volume.

12. A method of operating an ion source in a mass spectrometer, the method comprising:

directing an electric current to a first electron source;

heating the first electron source to emit electrons;

directing the electrons emitted from the first electron source through a first anode and into a first ionization volume, wherein the first anode at least partially surrounds the first ionization volume;

using the electrons to generate ions within the first ionization volume;

diverting the electric current from the first electron source to a second electron source;

heating the second electron source to emit electrons;

directing the electrons emitted from the second electron source through a second anode and into a second ionization volume, wherein the second anode at least partially surrounds the second ionization volume;

using the electrons to generate ions within the second ionization volume; and guiding ions from the second ionization volume to an ion exit using a potential applied to the first anode, wherein the first anode, the second anode, the first ionization volume, and the second ionization volume are positioned along an ion optical axis of the mass spectrometer, and wherein the first anode is positioned between the second anode and the ion exit.

13. The method of claim 12, further comprising setting a potential of the first electron source equal to the potential of the first anode when the second electron source is emitting electrons and ions are generated in the second ionization volume.

14. The method of claim 12, wherein diverting the electric current from the first electron source to the second electron source is done after a failure of the first electron source.

15. A method of operating an ion source in a mass spectrometer to analyze a gas sample, the method comprising:

providing an ion source assembly, wherein the ion source assembly comprises, a first anode at least partially surrounding a first ionization volume, and a first electron source comprised of a first material and configured to emit electrons through the first anode into the first ionization volume, a second anode at least partially surrounding a second ionization volume, and a second electron source comprised of a second material and configured to emit electrons through the second anode into the second ionization volume, wherein the second material is different from the first material and comprises different chemical properties than the first material, and at least one ion optical element defining an ion exit; and operating one of the first and second electron sources for analysis of the gas sample based on a tolerance of the first material and the second material to the gas sample, wherein the first anode, the second anode, the first ionization volume, and the second ionization volume are positioned along an ion optical axis of the mass spectrometer, and wherein the first anode is positioned between the second anode and the ion exit.

16. The ion source assembly of claim 1, wherein at least one of the first electron source and the second electron source at least partially surrounds at least one of the first anode and the second anode.

17. The method according to claim 12, wherein at least one of the first electron source and the second electron source at least partially surrounds at least one of the first anode and the second anode.

18. The method according to claim 15, further comprising structuring at least one of the first electron source and the second electron source to at least partially surrounds at least one of the first anode and the second anode.

* * * * *